US006425330B1

(12) United States Patent
Weber et al.

(10) Patent No.: US 6,425,330 B1
(45) Date of Patent: Jul. 30, 2002

(54) METHOD FOR CHANGING A PRINTING PLATE

(75) Inventors: Karlheinz Weber, Neu-Isenburg; Michael Rother, Rödermark; Berthold Seib, Rodgau; Bernd Lindner, Heusenstamm; Helmut Schild, Steinbach/Ts; Reinhold Heilmann, Haibach, all of (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/619,208

(22) Filed: Jul. 19, 2000

(30) Foreign Application Priority Data

Jul. 20, 1999 (DE) ..... 199 33 943

(51) Int. Cl.[7] ..... B41L 47/14; B41F 27/12
(52) U.S. Cl. ..... 101/477; 101/484; 101/485
(58) Field of Search ..... 101/477, 415.1, 101/409, 484, 485, 486

(56) References Cited

U.S. PATENT DOCUMENTS 5,127,328 A * 7/1992 Wieland ..... 101/415.1
5,213,042 A * 5/1993 Larios ..... 101/450.1
5,331,892 A 7/1994 Seib et al. ..... 101/477
5,479,859 A * 1/1996 Lindner et al. ..... 101/485
5,992,325 A * 11/1999 Schumann et al. ..... 101/477
6,189,452 B1 * 2/2001 Halup et al. ..... 101/415.1

FOREIGN PATENT DOCUMENTS

DE 42 15 969 A1 12/1993
EP 0 132 799 A2 * 2/1985 ..... 101/183
EP 0 654 349 A1 11/1994
EP 0 660 777 B1 12/1996

* cited by examiner

*Primary Examiner*—Leslie J. Evanisko
(74) *Attorney, Agent, or Firm*—Leydig, Voit & Mayer, LTD

(57) ABSTRACT

A method and apparatus for changing a printing plate on a plate cylinder in a sheet-fed offset printing machine is provided. The printing plate is first fed to the plate cylinder with its print-end edge leading the print-start edge. The print-end edge of the printing plate is then fixed in a first fixing device on the plate cylinder assigned to the print-end edge of the printing plate. The plate cylinder is then rotated in a direction opposite to the direction of rotation used during a printing operation to draw the printing plate around the outer circumference of the plate cylinder. The print-start edge of the printing plate is then fixed to a second fixing device on the plate cylinder that is assigned to the print-start edge of the printing plate and tensioned on the plate cylinder.

6 Claims, 9 Drawing Sheets

METHOD FOR CHANGING A PRINTING PLATE

FIELD OF THE INVENTION

The present invention relates to a method and an apparatus for changing a printing plate.

BACKGROUND OF THE INVENTION

In sheet-fed offset printing machines, the printing formes, designed as printing plates, are held on the plate cylinder (forme cylinder) by a respective fixing device, configured as a clamping rail, at the location corresponding to the start of the print and the location corresponding to the end of the print. After the printing plate has been fixed in position, the plate is tensioned through the exertion of a tensile force.

To remove a used printing plate from the plate cylinder, the fixing device assigned to the end of the print is first loosened, so as to free the end of the printing plate. By rotating the plate cylinder backwards (i.e. the direction opposite to the direction of rotation during printing), the printing plate is led off the plate cylinder. This is accomplished by rotating the plate cylinder backwards until it has assumed a position in which, after the fixing device assigned to the start of the print has been loosened, the printing plate can be removed completely from the cylinder. Semi-automatic or fully automatic printing-plate changers can be used, by means of which the printing plate can be removed from the cylinder and from the printing unit and/or transferred into a storage chamber or another holding device.

To feed a new printing plate, the cylinder is first moved into a position in which a printing plate brought up tangentially with respect to the cylinder can be inserted with the edge assigned to the start of the print into a corresponding fixing device. After the appropriate edge of the printing plate has been inserted into the fixing device assigned to the start of the print, the printing plate is fixed (clamped) to the plate cylinder. The printing plate cylinder is then rotated in the forward direction until the printing plate has been drawn nearly completely around the outer circumference of the plate cylinder. As the plate cylinder is rotated, an appropriate tensile force is exerted on the printing plate by means of additional pressure rollers, such that the printing plate is placed smoothly onto the outer circumference of the cylinder. The forward rotation of the plate cylinder continues until the edge of the printing plate corresponding to the print end can be inserted by means of an associated pressure roller into the fixing device on the cylinder assigned to the print end.

After the trailing edge of the printing plate (i.e. the end of the plate corresponding to the print end) has been fixed (clamped) to the plate cylinder, the printing plate is tensioned by building up a tensile force on the print-end fixing device. In particular, this tensile force can be applied by spring elements. Devices for the automated changing of printing plates on a plate cylinder, in which the operations described above are carried out, are disclosed in DE 4215969 C2 and EP 0654349 A1. In addition, EP 0660777 B1 discloses an apparatus for feeding printing plates to the plate cylinder and removing them from the plate cylinder, in which both the feeding and removing operations are carried out with the plate cylinder rotating in a single direction. In particular, the printing plate being removed is released at the start of the print and is conveyed with the print-start edge of the plate at the front into an appropriate storage chamber.

A common factor with all of these devices is that the printing plate is changed from the deliverer side, that is to say from the side of the printing unit which is assigned to the deliverer of the sheet-fed printing machine. In the case of sheet-fed printing machines and, in particular, sheet-fed offset printing machines having an in-line design, the side of the machine assigned to the deliverer is generally easily accessible, i.e. portions of the blanket cylinder and printing plate cylinder are accessible after a slide or folding guard has been opened. The portions of the printing units which face the feeder of the sheet-fed printing machine are primarily occupied by the rolls of the inking and damping units, so that the printing plates cannot be changed from the feeder side of the machine. Accordingly, devices for the semi-automatic and fully automatic changing of printing plates are also fitted on the deliverer side of the printing units.

In sheet-fed printing machines and, in particular, sheet-fed offset printing machines having a verso printing unit upstream of the standard printing units, problems relating to the accessibility of the plate cylinder arise because of the arrangement of the printing plate cylinder in conjunction with its direction of rotation, as well as the interaction of the rolls of the damping and/or inking unit with the plate cylinder. These problems are particularly acute when the verso printing unit is arranged with the appropriate plate cylinder underneath the delivery table of a feeder. A sheet-fed offset printing machine with an upstream verso printing unit is disclosed, for example, by DE 4343616 A1.

Because of the restricted accessibility to the plate cylinder within a verso printing device, the known methods and apparatus for changing a printing plate cannot be used or cannot be used without substantial additional production costs.

OBJECTS AND SUMMARY OF THE INVENTION

Accordingly, in view of the foregoing, a general object of the present invention is to provide a method and a corresponding apparatus by which the printing plate of a plate cylinder of a sheet-fed printing machine, more particularly a plate cylinder of a verso printing device, can be changed simply and without the need for any additional components.

The present invention provides this and other advantages and overcomes the drawbacks of the prior art by providing a method and corresponding apparatus by which the feeding and removal of a printing plate to and from a plate cylinder are carried out using rotational directions of the cylinder which are reversed with respect to conventional methods. In particular, when a printing plate is fed to the plate cylinder, the edge of the plate assigned to the end of the print (i.e., the print-end edge) is first fixed to the plate cylinder fixing device which corresponds to the print end. The plate cylinder is then rotated in the direction opposite to the direction of rotation used during a printing operation, until the new printing plate has been drawn nearly completely around the outer circumference of the plate cylinder. The edge of the printing plate assigned to the start of the print (i.e. the print-start edge) is then fixed to the fixing device corresponding to the print start.

To convey a used printing plate away from the plate cylinder, the print-start edge of the printing plate is first detached (released) from its corresponding fixing device and the plate cylinder is rotated in the direction that is used during a printing operation (i.e. the printing direction). Once the plate cylinder has been rotated in this direction, the printing plate can be removed, for example by hand. Alternatively, an appropriate printing plate holding device can be assigned to the plate cylinder into which the printing plate being removed can be conveyed.

The plate cylinder is rotated in the printing direction until the print-end edge of the printing plate can be released from its corresponding fixing device. Depending on the design of the corresponding fixing device for the print-end edge of the printing plate, the plate cylinder is stopped briefly in this position in order to activate an actuating device associated with the fixing device.

Because a new printing plate is fed to the plate cylinder beginning with the print-end edge of the plate and the plate cylinder is rotated in the direction opposite to the direction used during printing in order to draw the printing plate onto the cylinder, the printing plate can be changed in the area between the blanket cylinder and damping and/or inking unit. This corresponds to the feeder side of both a sheet-fed offset printing machine having an in-line design and a verso printing unit of a sheet-fed offset printing machine having a plate cylinder arranged underneath the corresponding impression cylinder. Thus, the present invention allows the printing plates to be changed from the feeder side in such printing machines.

The method according to the invention is preferably used in plate cylinders of verso printing units of sheet-fed offset printing machines. In the case of sheet-fed offset printing machines having an in-line design, in which there is a verso printing unit arranged upstream from the first printing unit for the recto print, the method of the present invention allows the printing plates in the first verso printing unit can be changed in a simple, straightforward manner. If appropriately designed protective devices are provided for the plate cylinder of the verso printing unit, a printing plate changing operation can be executed in a convenient manner and in which only a few handling operations are required. Likewise, the method and the apparatus of the present invention can be used in instances where the plate cylinders interact directly with an impression cylinder in varnishing units of sheet-fed offset printing machines.

The method of the present invention also permits a plate cylinder to be used in the verso printing unit or in the varnishing unit that is essentially identical in construction and with regard to the arrangement of the fixing devices for the edges of the printing plate as compared to the cylinders of the other printing units. In such a case, the plate cylinder in the verso printing unit rotates in the opposite direction during printing. In other words, the fixing device assigned to the start of the print in the case of the plate cylinder in the recto printing unit is assigned to the end of the print in the plate cylinder of the verso printing unit. Similarly, the fixing device assigned to the end of the print in the recto printing unit is assigned to the start of the print in the plate cylinder of the verso printing unit.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
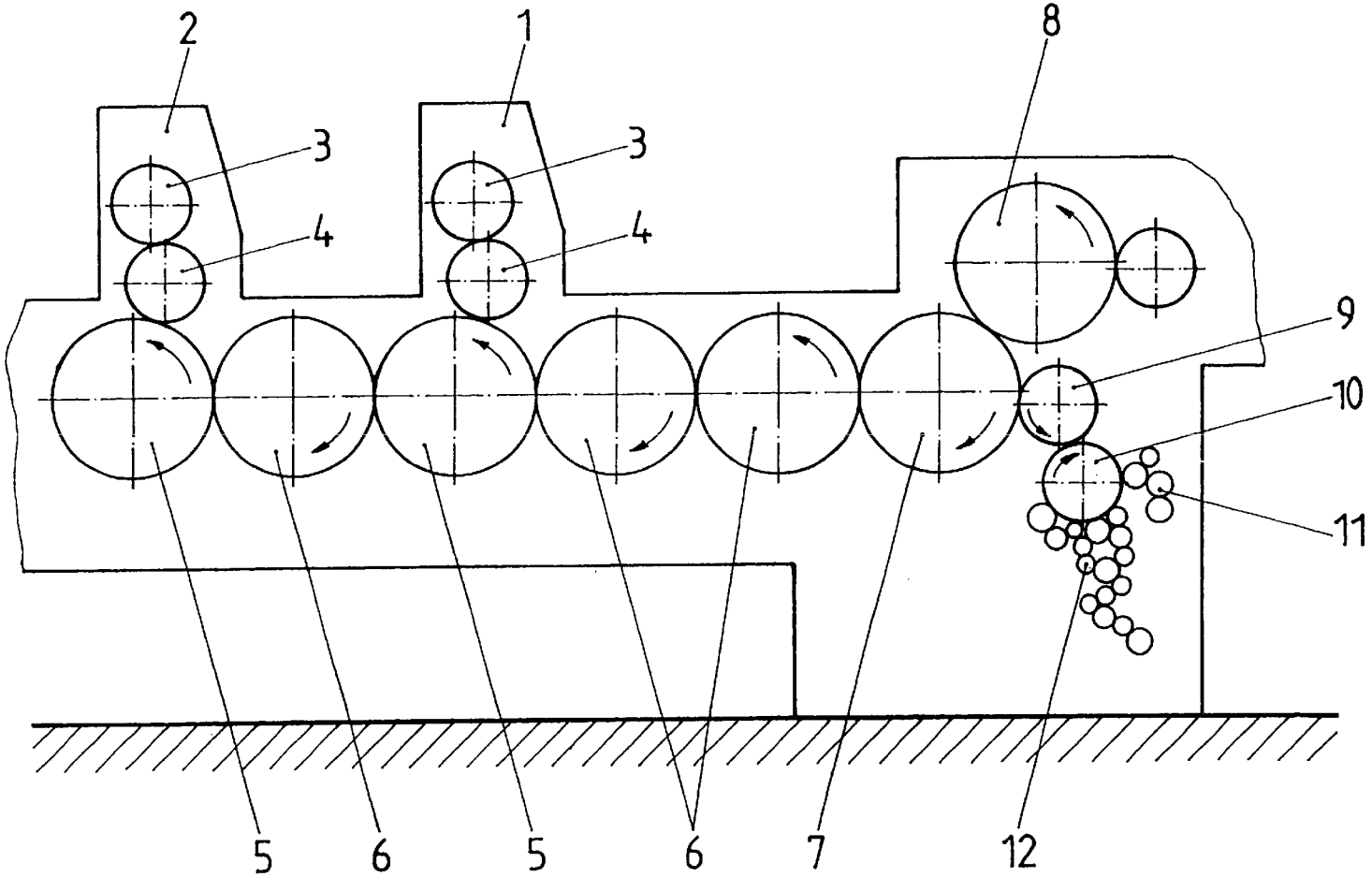
FIG. 1 is a schematic side elevation view of an illustrative sheet-fed offset printing machine having an in-line design and an upstream verso printing unit in accordance with the present invention.

Referring now more particularly to the FIG. 1 of the drawings, there is shown an illustrative sheet-fed offset printing machine having an in-line design which includes two printing units 1 and 2. In the printing units 1 and 2, the plate cylinders 3 interact in a known manner with blanket cylinders 4 and impression cylinders 5 (which, in this case, have twice the diameter of the blanket and plate cylinders). The sheets are transported between the impression cylinders 5 and to the first impression cylinder 5 of the first printing unit 1 via transfer drums 6. A verso printing unit is arranged upstream of the first printing unit 1. The verso printing unit comprises an impression cylinder 7 arranged between two transfer drums 6, 8, a blanket cylinder 9 and a plate cylinder 10. The blanket cylinder 9 and the plate cylinder 10 of the verso printing unit are arranged underneath the impression cylinder 7, such that the damping unit 11 and the inking unit 12 also can be arranged underneath the plate cylinder 10. The feeder of this printing machine is not shown in FIG. 1, but is located upstream and (with respect to the drawings) to the right of the verso printing unit.

Figure 2:
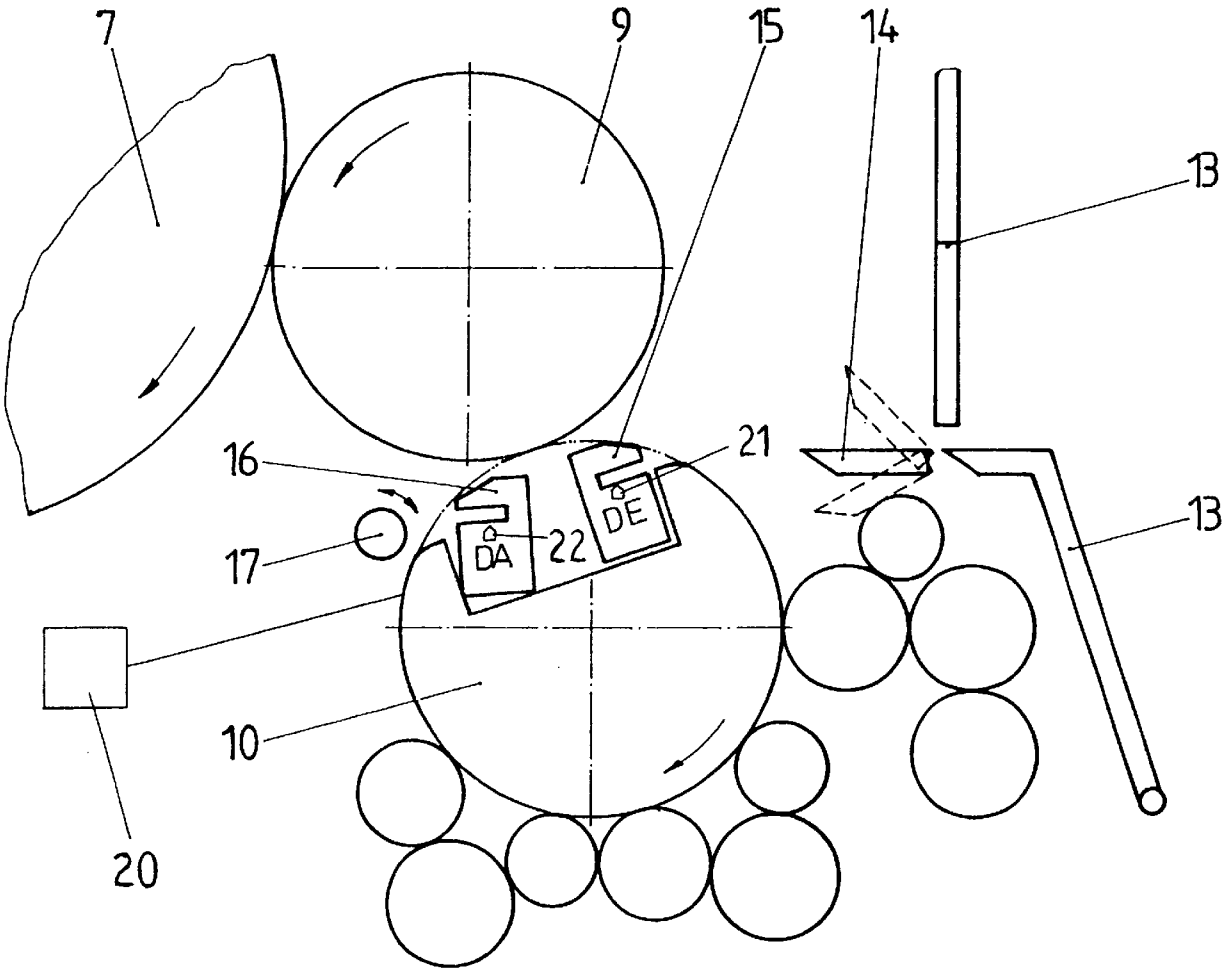
FIG. 2 is an enlarged schematic side elevation view of the verso printing unit of FIG. 1.

Because of the arrangement of the impression cylinder 7, blanket cylinder 9 and plate cylinder 10 (shown in FIG. 1), as well as the arrangement of the rolls of the damping unit 11 and of the inking unit 12, the plate cylinder 10 is accessible only from the right (with respect to the drawings) in order to change the printing plate, i.e. from the direction of the feeder. Protective elements are arranged in this area which have to be opened in order to change a printing plate. In the illustrated embodiment, these protective elements include an outer guard 13 and an inner guard which is pivotable, in this case, into three different positions (see, e.g. FIG. 2). As will be appreciated, these protective elements can be actuated appropriately.

Figure 3:
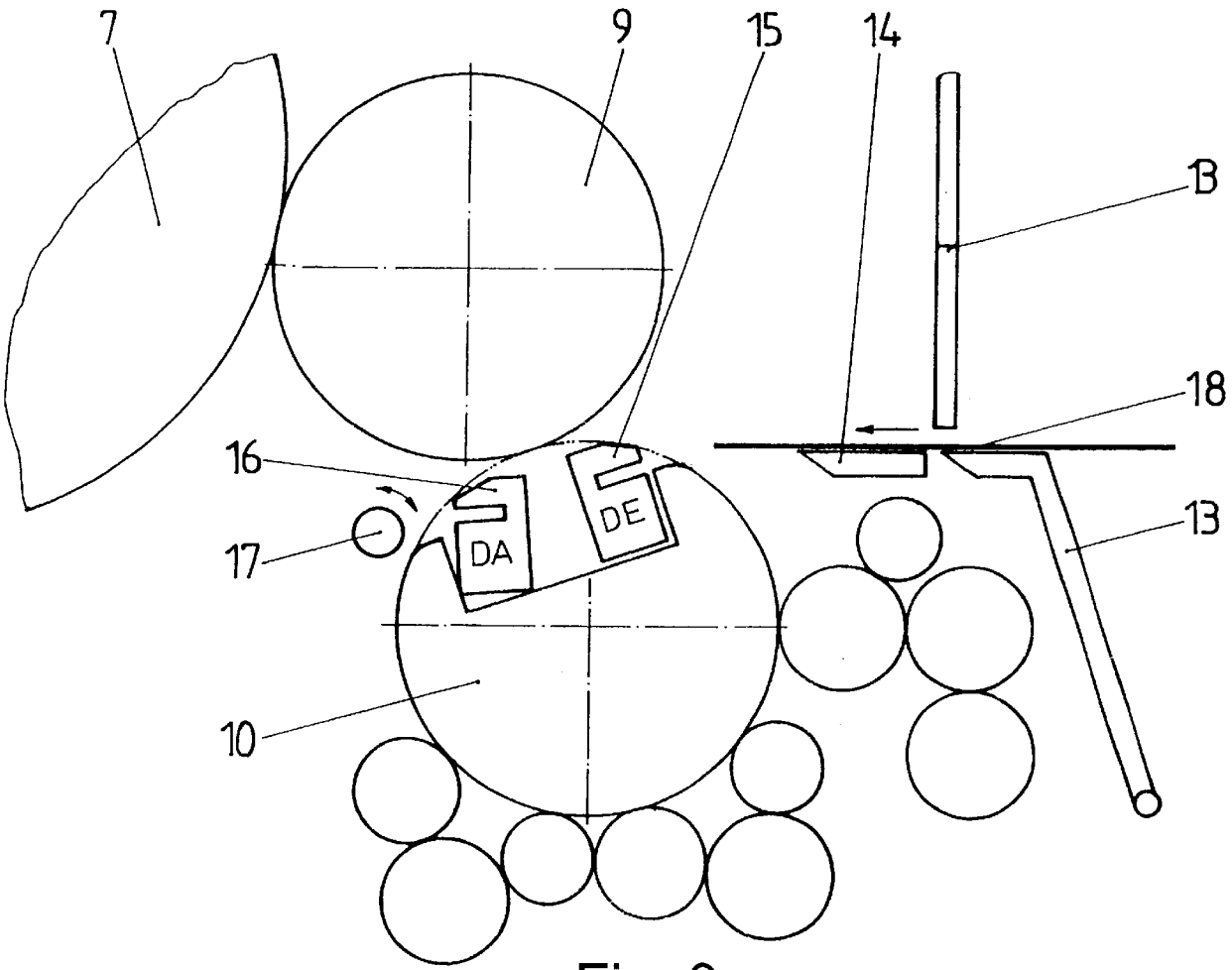
FIG. 3 is an enlarged schematic side elevation view of the verso printing unit of FIG. 1 showing a new printing plate being fed to the plate cylinder.

In order to install a new printing plate on the plate cylinder, the new printing plate 18 is fed to the plate cylinder 10 through a gap formed between the upper and lower part of the outer guard 13 as shown in FIG. 3. The inner guard 14 is pivoted into a horizontal position such that the surface of the inner guard 14 and part of outer guard 13 provide a horizontal support for the printing plate being fed to the plate cylinder. The plate cylinder 10 has previously been moved such a position such that the fixing device 15 (clamping rail) assigned to the end of the print-end DE can grip the appropriate print-end edge of the printing plate 18. To roughly align the printing plate 18 in the side register direction (the axial direction of the plate cylinder 10), aligning mechanisms are arranged on the top of the horizontal portion of the outer guard 13 and/or the inner guard.

Figure 4:
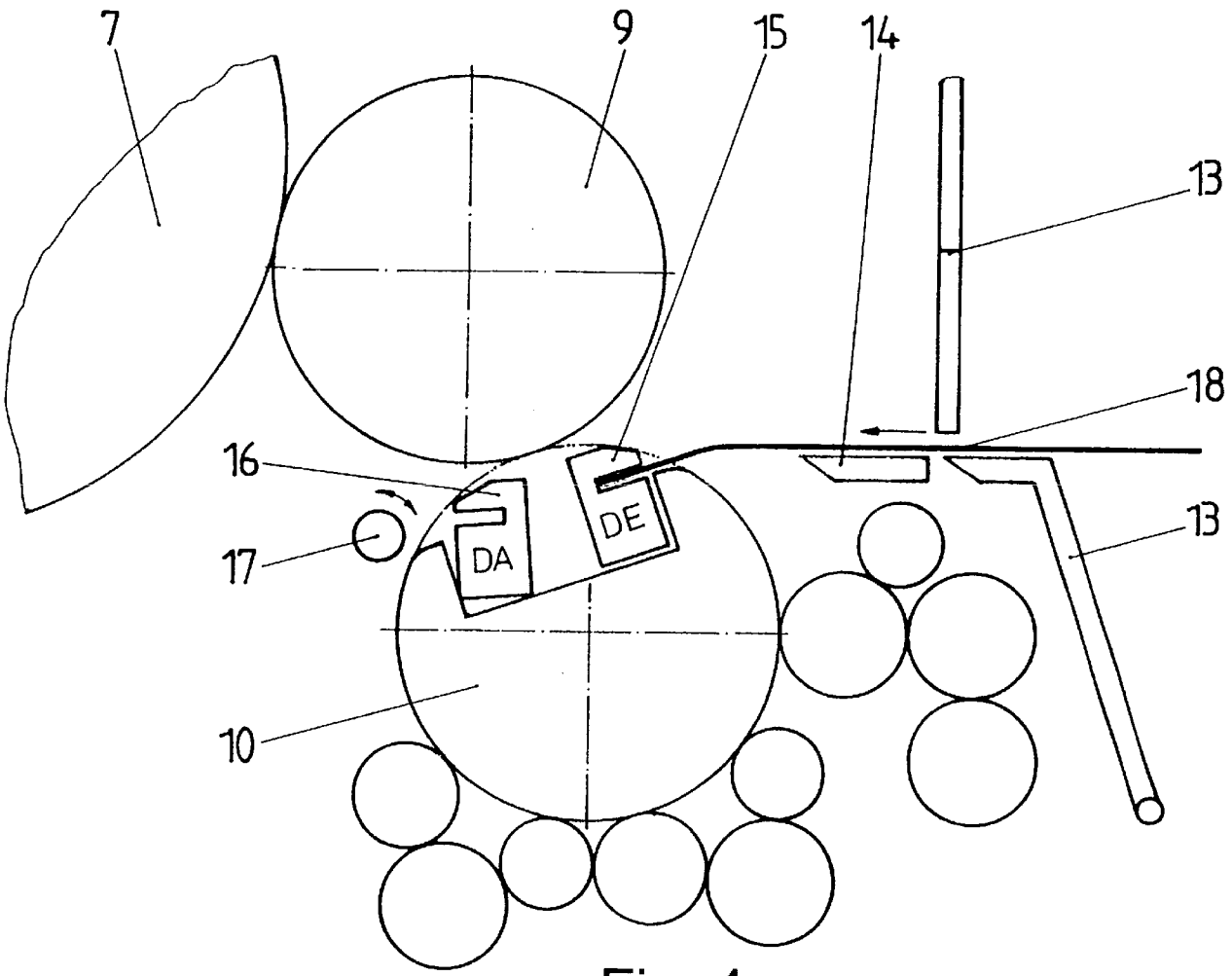
FIG. 4 is an enlarged schematic side elevation view of the verso printing unit of FIG. 1 showing print-end edge of the new printing plate being fixed in its corresponding fixing device.

As shown in FIG. 4, once the printing plate 18 has been inserted through the gap between the upper and lower guard 13 into the print-end DE fixing device 15, the print-end DE of the printing plate 18 is clamped by activating an associated actuating. The print-end DE edge of the printing plate 18 is thereby fixed to the plate cylinder 10.

Figure 5:
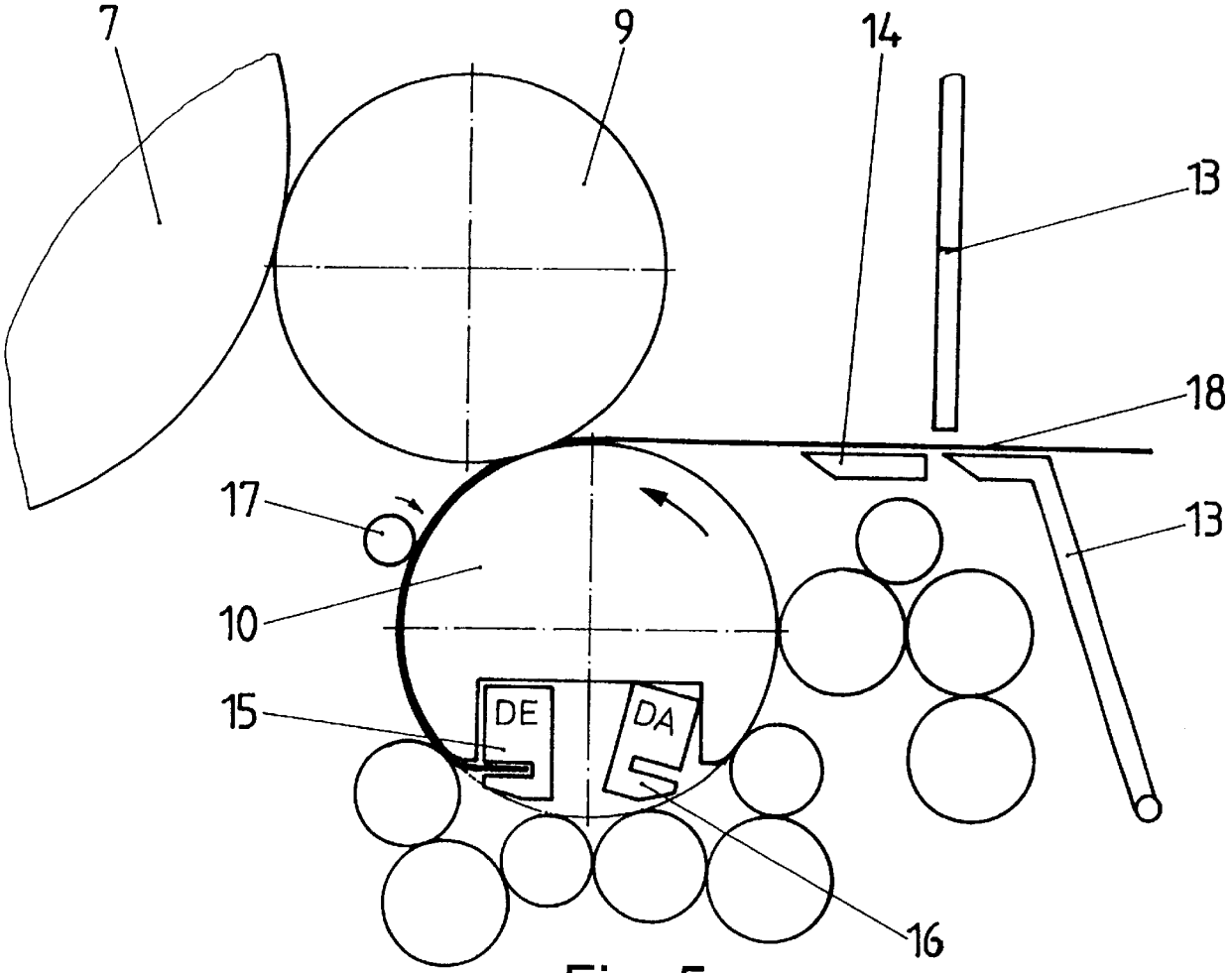
FIG. 5 is an enlarged schematic side elevation view of the verso printing unit of FIG. 1 showing the new printing plate being drawn around the outer circumference of the plate cylinder.

After the printing plate 18 has been fixed in the print-end DE fixing device 15 on the plate cylinder 10, the plate cylinder 10 is then rotated in the direction opposite to that used during printing (in this regard, cf. FIGS. 2–5), as indicated by the arrow in FIG. 5. As a result of this rotation of the plate cylinder, the printing plate 18 is drawn around the outer circumference of the plate cylinder 10 with the assistance of the pressure roll which is brought into contact with the plate cylinder. In the process, the printing plate 18 runs through the gap between the plate cylinder 10 and the blanket cylinder 9.

Figure 6:
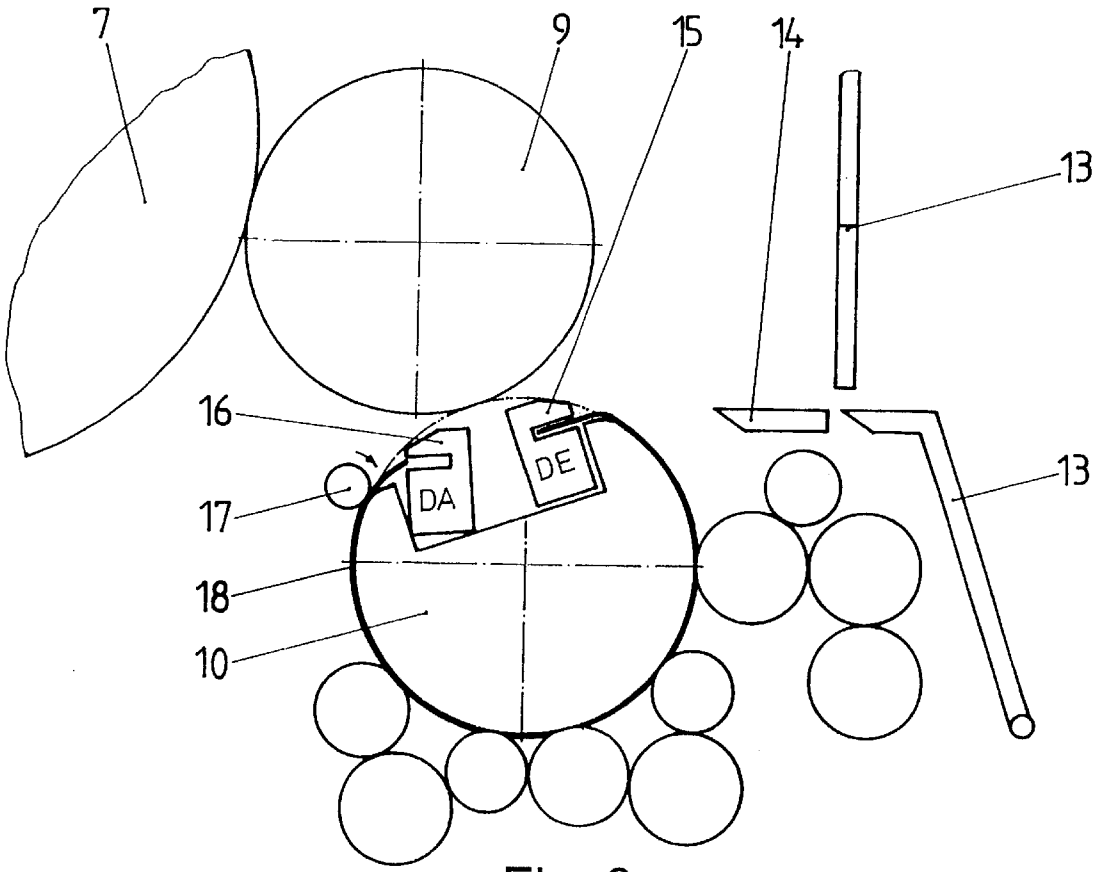
FIG. 6 is an enlarged schematic side elevation view of the verso printing unit of FIG. 1 showing the print-start edge of the new printing plate in position to be inserted into its corresponding fixing device.
Figure 7:
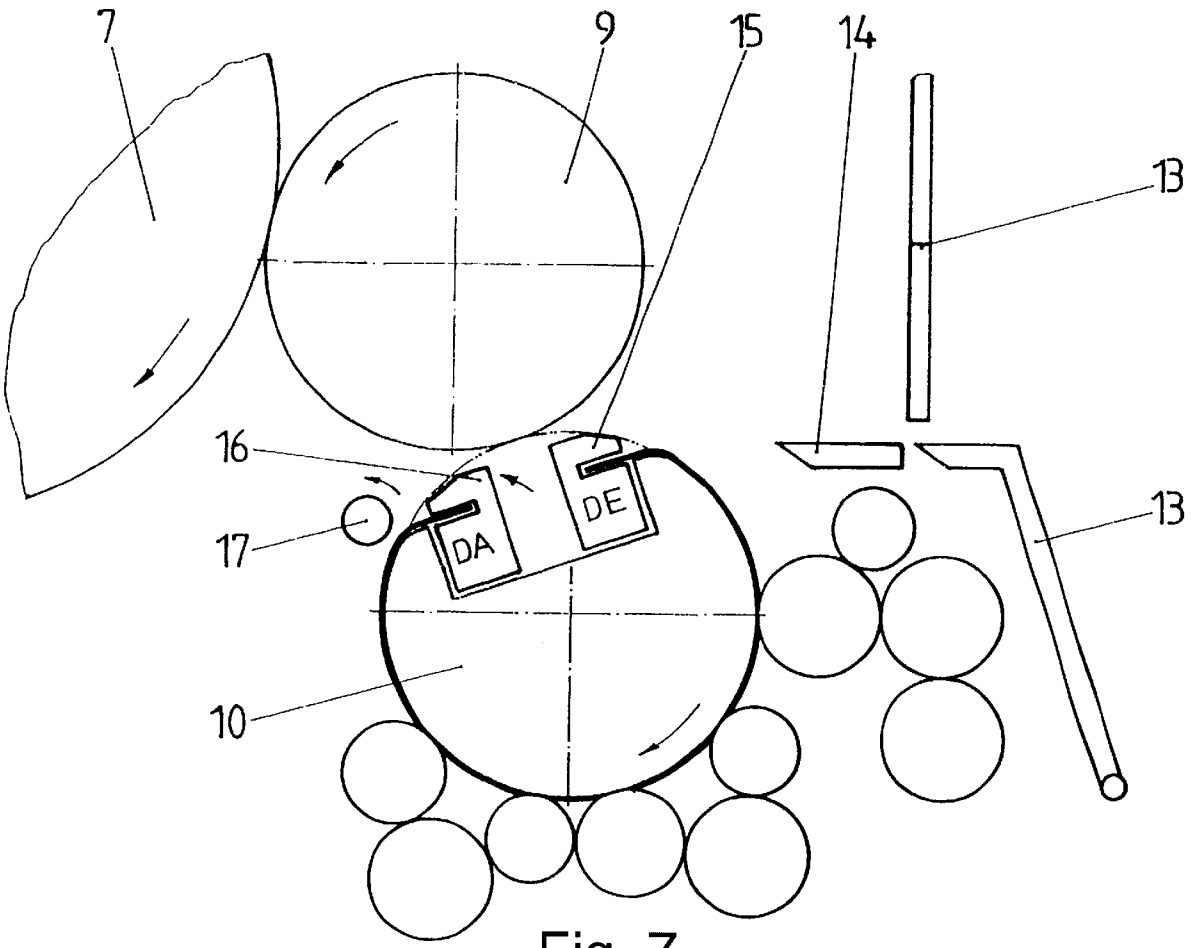
FIG. 7 is an enlarged schematic side elevation view of the verso printing unit of FIG. 1 showing the print-start edge of the new printing plate fixed in its corresponding fixing device.

As shown in FIG. 6, the plate cylinder 10 is rotated until the printing plate 18 has been drawn completely around the outer circumference of the plate cylinder 10, and the start of the print on the printing plate 18 is opposite the gripping area (gap) of the clamping rail so as to be insertable into the fixing device 16 assigned to the print start DA. The print-start DA edge of the printing plate 18 is gripped and then clamped as a result of the fixing device 16 being pivoted forwards (FIG. 7). Next, the printing plate 18 is tensioned by building up a force which acts in the circumferential direction of the plate cylinder, in particular by means of spring elements associated with the fixing device 16.

Figure 8:
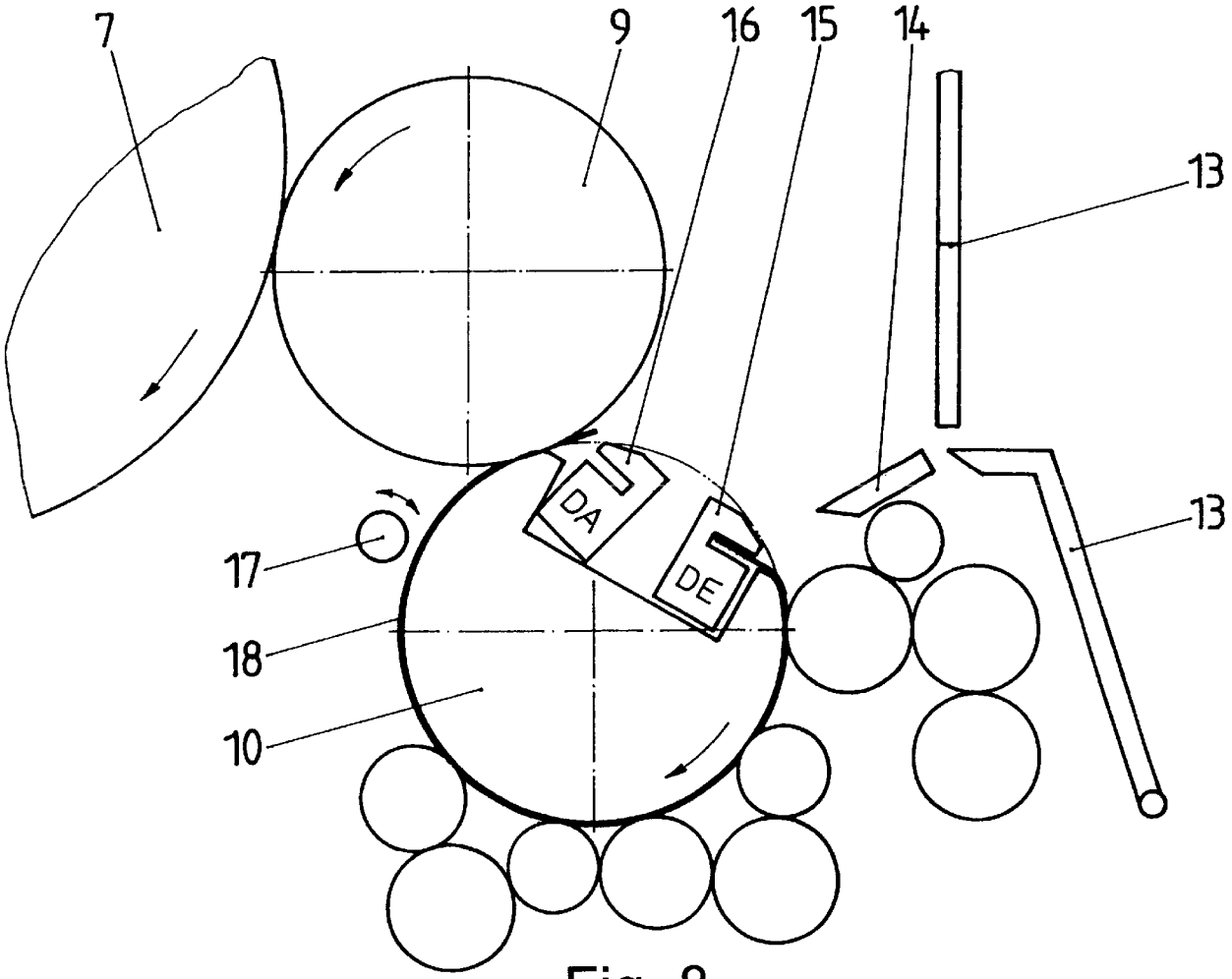
FIG. 8 is an enlarged schematic side elevation view of the verso printing unit of FIG. 1 showing the print-start edge of the printing plate being released from its corresponding fixing device in order to begin a printing plate removal operation.
Figure 9:
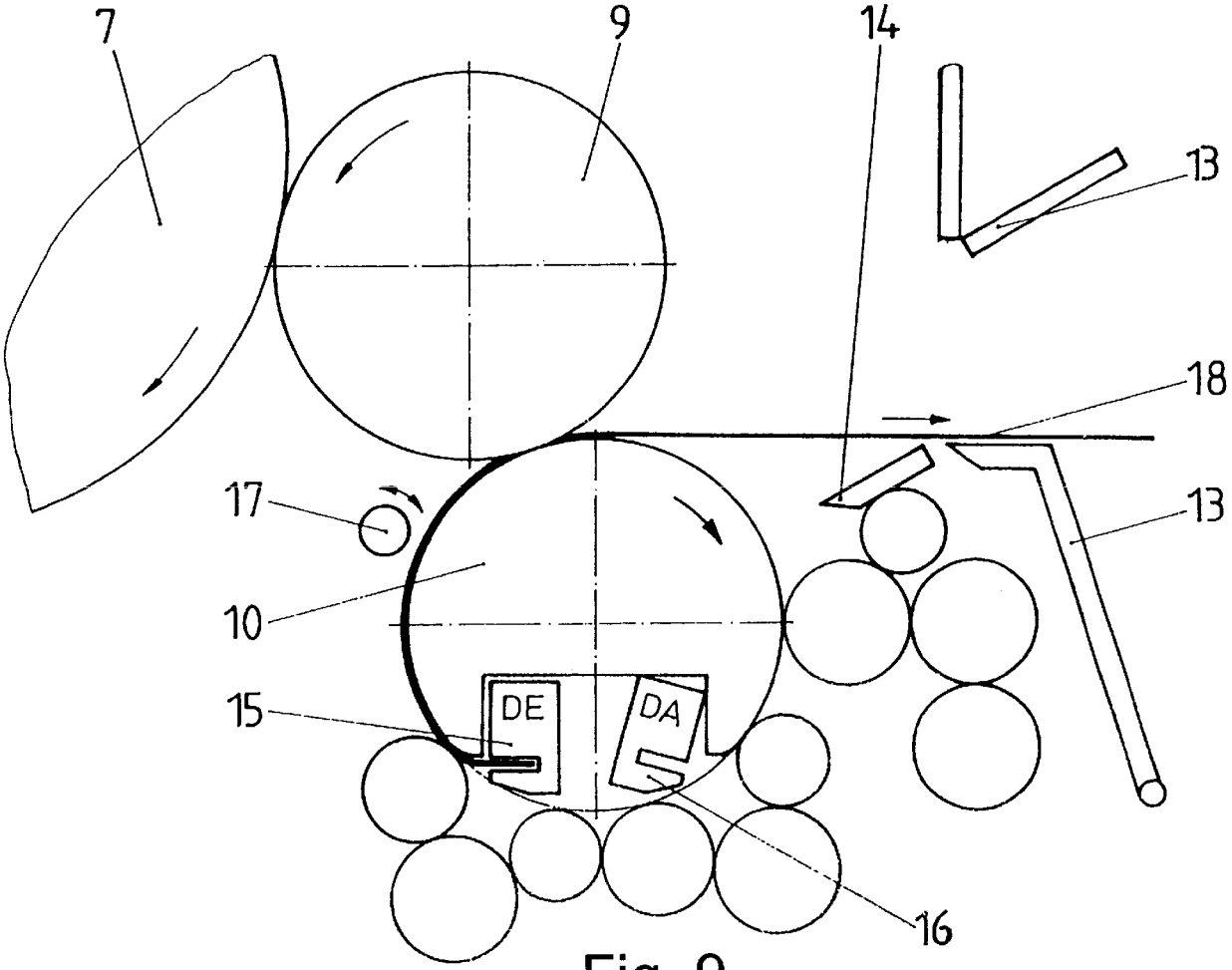
FIG. 9 is an enlarged schematic side elevation view of the verso printing unit of FIG. 1 showing the printing plate being drawn off of the plate cylinder.

In order to remove printing plate 18 from the plate cylinder 10, the plate cylinder 10 is rotated, in the direction used during printing, into the position shown in FIG. 8, and the fixing device 16 holding the print-start DA edge of the printing plate 18 is released. As a result of the plate cylinder 10 being driven in the direction of rotation executed during printing, the released print-start DA end of the printing plate 18 is conveyed away from the plate cylinder 10. As shown in FIG. 9, in order to allow for removal of the printing plate 18, part of the outer guard 13 is designed such that it can be folded upwards into an open position and the inner guard 14 is pivotable into a lower position. The plate cylinder 10 is rotated in the direction executed during printing until the cylinder has assumed the position shown in FIGS. 2 to 4 in connection with the insertion of a new printing plate 18 and, after the fixing device 15 holding the print-end DE has been released, the printing plate 18 can be removed from the plate cylinder 10.

According to one preferred embodiment of the invention, the successive operations associated with changing the printing plate 18 can be automated. To this end, a plate detection system, such as sensors 21, or alternatively, register pins or electrical contacts, can be provided for the fixing device 15 assigned to the end of the print on the plate cylinder 3. This plate detection system can generate a signal to direct the plate cylinder 3 to rotate in order to draw the new printing plate 18 onto the plate cylinder once the new printing plate being fed to the cylinder is place in the appropriate position.

According to a further preferred embodiment of the invention, sensors 22 for detecting the in-register position of the printing plate 18 are also provided for the fixing device 16 assigned to the print start on the plate cylinder 3. Once a new printing plate 18 has been drawn around the outer circumference of the plate cylinder 3 and the print-start edge DA of the plate has been inserted into the corresponding fixing device 16, these sensors can signal to an indicating device that the printing plate is resting in-register. If the plate detection systems provided for either of the fixing devices 15, 16 are designed as electrically interrogated register pins, then the printing plate 18 can be provided with appropriate stamped-out portions at the print-start edge and/or the print-end edge of the printing plate.

The apparatus according to the invention also can include a drive 20 with an associated control system (schematically shown in FIG. 2) that can rotate the plate cylinder 3 in the direction opposite to that executed during printing in order to draw on the new printing plate 18. In particular, the drive 20 associated with the plate cylinder 3 can be the main drive of the printing machine which is activated appropriately in order to change the printing plate.

According to a further development of the invention, the plate detection system assigned to the print-start and the print-end on the plate cylinder 3 also have a signal connection to the control system of the printing machine that is arranged hierarchically above the drive 20. As a result, an automated program sequence is possible in which the plate cylinder 3 is first moved into a predetermined position, and then the print-end edge of the new printing plate 18 is inserted into the corresponding fixing device 15. After the plate detection system associated with the print-end DE fixing device 15 signals that the plate 18 is positioned correctly, the fixing device is closed (through activation of a corresponding actuating device), and the plate cylinder 3 is rotated in the direction opposite to the direction used during printing to draw on the new printing plate. The plate cylinder 3 is then stopped in the appropriate position for the insertion of the print-start edge into the associated fixing device 16. After the print-start edge has been inserted into the associated fixing device 16 (e.g., by bringing the pressure roller 17 or the like into contact), the actuators controlling the print-start DA fixing device 16 are then activated so as to clamp down on the plate 3 until plate detection system arranged in the fixing device signals the presence of the print-start edge of the printing plate 18. The print-start edge of the printing plate is then fixed (clamped) in the correct position.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A method of changing a printing plate on a plate cylinder in a sheet-fed offset printing machine, the printing plate having a print-end edge at an end of a print end of the plate and a print-start edge at a start of a print end of the plate and the printing machine being configured such that the plate cylinder rotates in a printing direction during a printing operation, the method comprising the steps of:

feeding the printing plate to the plate cylinder with the printing plate oriented with the print-end edge leading the print-start edge, fixing the print-end edge of the printing plate to a first fixing device on the plate cylinder assigned to the print-end edge of the printing plate, rotating the plate cylinder in a direction opposite to the printing direction to draw the printing plate around the outer circumference of the plate cylinder, fixing the print-start edge of the printing plate to a second fixing device on the plate cylinder that is assigned to the print-start edge of the printing plate, and tensioning the printing plate on the plate cylinder.

2. The method according to claim 1 wherein the tensioning step is performed by building up a tensile force from the print-start edge of the printing plate.

3. The method according to claim 1 further including the step of sensing the position of the print-end edge of the printing plate as the print-end edge is inserted into the first fixing device.

4. The method according to claim 3 wherein the step of fixing the print-end edge of the printing plate is performed when the print-end edge of the printing plate is sensed in a predetermined correct position.

5. The method according to claim 1 further including the step of sensing the position of the print-start edge of the printing plate as the print-start edge is inserted into the second fixing device.

6. The method according to claim 5 wherein the step of fixing the print-start edge of the printing plate is performed when the print-start edge of the printing plate is sensed in a predetermined correct position.

* * * * *